US006304192B1

(12) United States Patent
Kawasaki

(10) Patent No.: US 6,304,192 B1
(45) Date of Patent: Oct. 16, 2001

(54) AUTHORIZATION SYSTEM AND AUTHORIZATION METHOD

(75) Inventor: Akihisa Kawasaki, Kanagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/546,286

(22) Filed: Apr. 10, 2000

(30) Foreign Application Priority Data

Apr. 9, 1999 (JP) ..... 11-102898

(51) Int. Cl.[7] ..... G08G 1/065

(52) U.S. Cl. ..... 340/928; 340/933; 340/937; 340/825.34; 340/426; 340/571; 340/573

(58) Field of Search ..... 340/928, 933, 340/937, 825.34, 426, 571, 573

(56) References Cited

U.S. PATENT DOCUMENTS 4,963,723 * 10/1990 Masada ..... 235/384
5,422,473 * 6/1995 Kamata ..... 235/384
5,955,970 * 9/1999 Ando et al. ..... 340/928
5,962,833 * 10/1999 Hayashi ..... 235/384
6,042,008 * 3/2000 Ando et al. ..... 235/384
6,087,963 * 7/2000 Kobayashi et al. ..... 340/928

FOREIGN PATENT DOCUMENTS 8-221624 8/1996 (JP) .
10-55463 2/1998 (JP) .
10-326365 12/1998 (JP) .

* cited by examiner

*Primary Examiner*—Jeffery Hofsass
*Assistant Examiner*—Hung Nguyen
(74) *Attorney, Agent, or Firm*—Ratner & Prestia

(57) ABSTRACT

An authorization system for authorizing an IC card is provided. When an IC card—storing a different code from the code proper to an in-vehicle device and yet having been authorized by the in-vehicle device—inserted to the invehicle device, the system allows the in-vehicle device to authorize the IC card and vice versa. In other words, when an IC card having a different code from the proper code to the in-vehicle device is inserted into the in-vehicle device, an on-road apparatus disposed at a tollgate rewrites the code stored in the in-vehicle device to agree with the code stored in the IC card. As a result, the codes of the in-vehicle device and the IC card agree with each other, and thus the IC card can be authorized.

12 Claims, 5 Drawing Sheets

AUTHORIZATION SYSTEM AND AUTHORIZATION METHOD

FIELD OF THE INVENTION

The present invention relates to an authorization system and an authorization method both employed in an electronic toll collection system which collects tolls through unmanned tollgates. More particularly, it relates to the system and method that allow an in-vehicle-device to authorize an access of an IC card to the in-vehicle-device when the IC card has been authorized but has a different code from the code proper to the in-vehicle-device.

BACKGROUND OF THE INVENTION

An electronic toll collecting system automatically collects tolls by wireless communications between tollgates and vehicles on toll roads. This system allows vehicles to pay a toll keeping on driving and thus free from stopping at a tollgate. Therefore, this system can save manpower and alleviate traffic jam.

An authorization system for authorizing a vehicle by an IC card is available as one of these electronic toll collecting systems. The following elements make up the authorization system overall:

- an IC card;
- an in-vehicle-device for reading the IC card and processing the information; and
- an on-road apparatus mounted to a tollgate. The on-road apparatus automatically collects tolls by communicating data to a central processing unit (CPU) in an operation center.

When the IC card is inserted into a slot of the in-vehicle-device, the card and device try to authorize each other. When a code stored in the in-vehicle-device agrees with a code stored in the IC card, an authorization is established and the IC card authorizes the in-vehicle-device.

On the other hand, the in-vehicle-device can also authorize the IC card, and detects an agreement of the codes. The device detecting the code agreement communicates the on-road apparatus to authorize each other. When the respective codes agree with, they can authorize each other. Then the on-road apparatus starts communicating the CPU in the operation center about automatic toll collection.

When the code of IC card does not agree with the code of in-vehicle-device, although the in-vehicle-device and on-road apparatus authorize each other, the in-vehicle-device and the IC card cannot authorize each other.

As such, the conventional authorization system requires two-step authorizations i.e. the on-road apparatus authorizes the in-vehicle-device, and the device authorizes the IC card, and these three elements should store the code in common with them. Therefore, if one of the on-road apparatus, in-vehicle-device, or IC card has a code different from the common code, the authorization cannot be established among them.

SUMMARY OF THE INVENTION

The present invention addresses the problem discussed above and aims to provide an authorization system and an authorization method through which an IC card having been authorized and yet storing a code different from the code proper to an in-vehicle-device can be authorized by the in-vehicle-device.

In a two-step authorization system, i.e. an on-road apparatus authorizes the in-vehicle-device, and the in-vehicle-device authorizes an IC card, the authorization system of the present invention operates as follows. When the in-vehicle-device receives an IC card having a code different from the code proper to the device, the device communicates the on-road apparatus. Then the apparatus rewrites a code of the in-vehicle-device to agree with a code of the IC card so that the in-vehicle-device identifies the IC card as an authorized one. Thus an authorization is established between the IC card and the in-vehicle device.

DETAILED DESCRIPTION OF THE PREFERRED EMBODIMENT

An exemplary embodiment of the present invention is demonstrated hereinafter with reference to the accompanying drawings.

Figure 1:
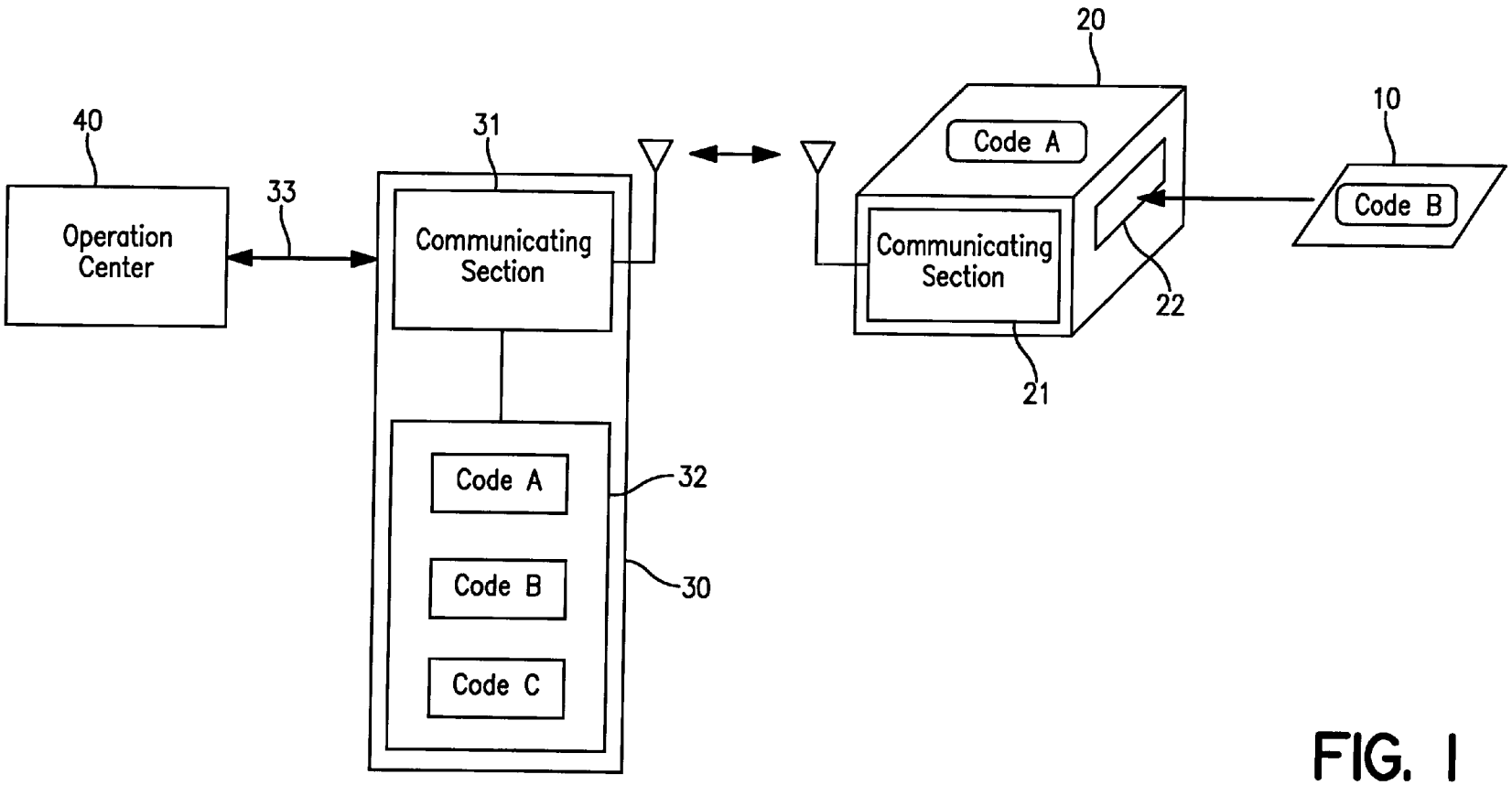
FIG. 1 is a block diagram illustrating an overall structure of an authorization system in accordance with an exemplary embodiment of the present invention.

FIG. 1 is a block diagram illustrating an overall structure of an authorization system of the present invention.

IC card 10 stores an ID number, a vehicle class, a travelling route, settlement of an account, and a code for authorization. In-vehicle-device 20 stores a code for authorizing IC card 10, and includes communicating section 21 for communicating on-road apparatus 30 about toll collection by reading information recorded in IC card 10. On-road apparatus 30 is disposed at a tollgate and equipped with the following elements:

(a) communicating section 31 for communicating in-vehicle-device 20 about collecting tolls;

(b) memory 32 for storing every possible code to be used in communications in the authorization system, such as code A, code B and code C as recited in FIG. 1; and (c) communication network 33 for communicating operation center 40.

The every possible code discussed above means every authorized code which is permitted to use in this authorization system. The IC cards storing these codes are produced only by designated manufacturers, and the IC cards do not authorize other IC cards having different coding systems.

Figure 2:
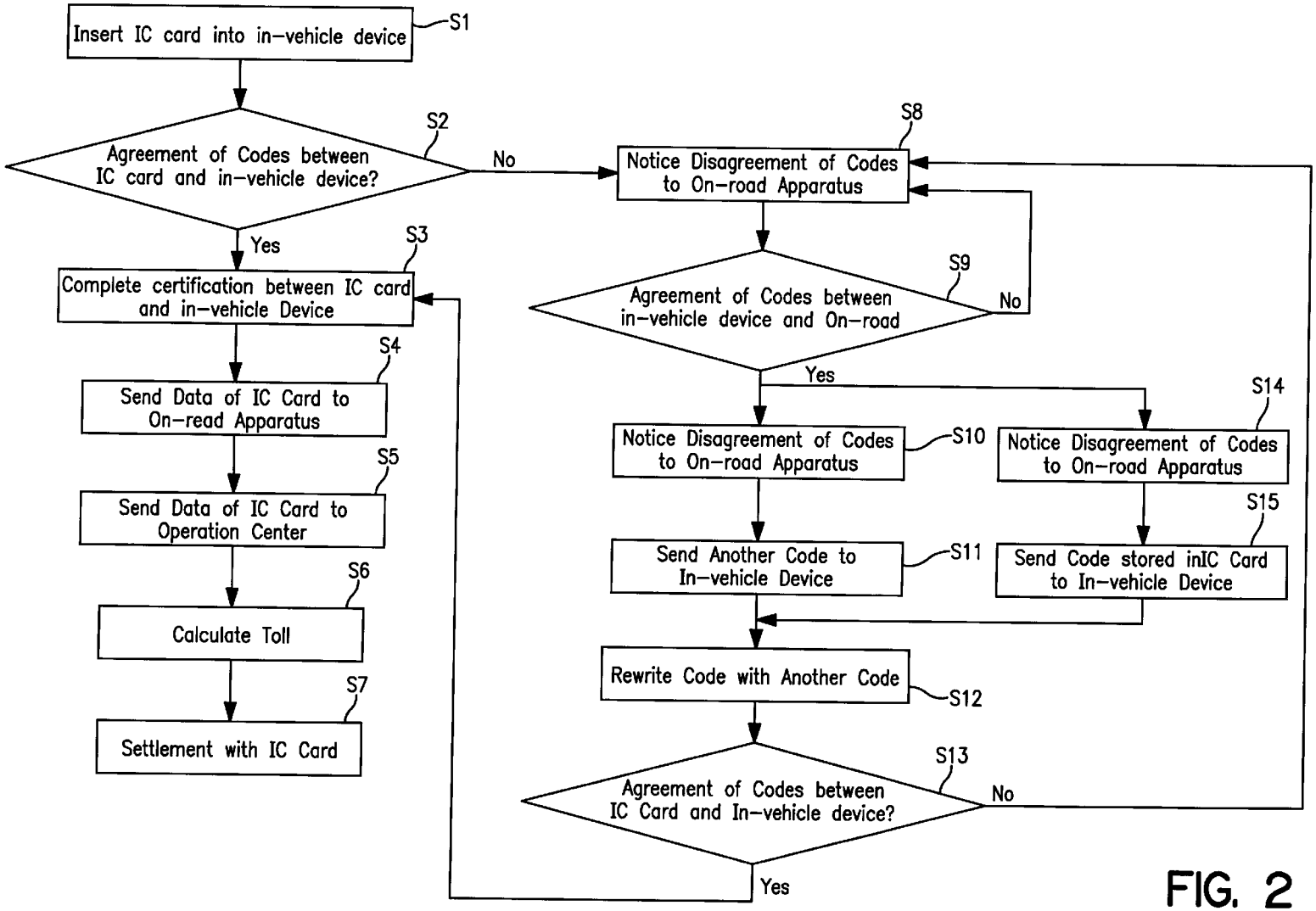
FIG. 2 is a flowchart illustrating an operation of the authorization system in accordance with the exemplary embodiment of the present invention.

An operation of this authorization system of the present invention is demonstrated hereinafter with reference to FIG. 1 and FIG. 2.

The in-vehicle device 20 has a code or cipher. The IC card 10 also has a code or cipher which is the same as or different from that of the code or cipher of the in-vehicle device 20. The on-road apparatus 30 has a plurality of codes or ciphers, all of which are allowed to be used in the electronic toll collecting system by a managing agency of the electronic toll collecting system.

Each of the codes or ciphers has a construction consisting of code key and coded data. The coded data is coded under the code key. In an exemplary embodiment of the present invention, the code agreement is performed by comparing each of the coded data between the IC card 10 and the in-vehicle device 20; and between the in-vehicle device 20 and the on-road apparatus 30. If the code keys are coincident with each other, the code agreement occurs. The comparison may be accomplished by performing an exclusive OR function between the respective coded data. Code agreement may be indicated, for example, by deriving a "1" from the exclusive OR function.

Figure 3:
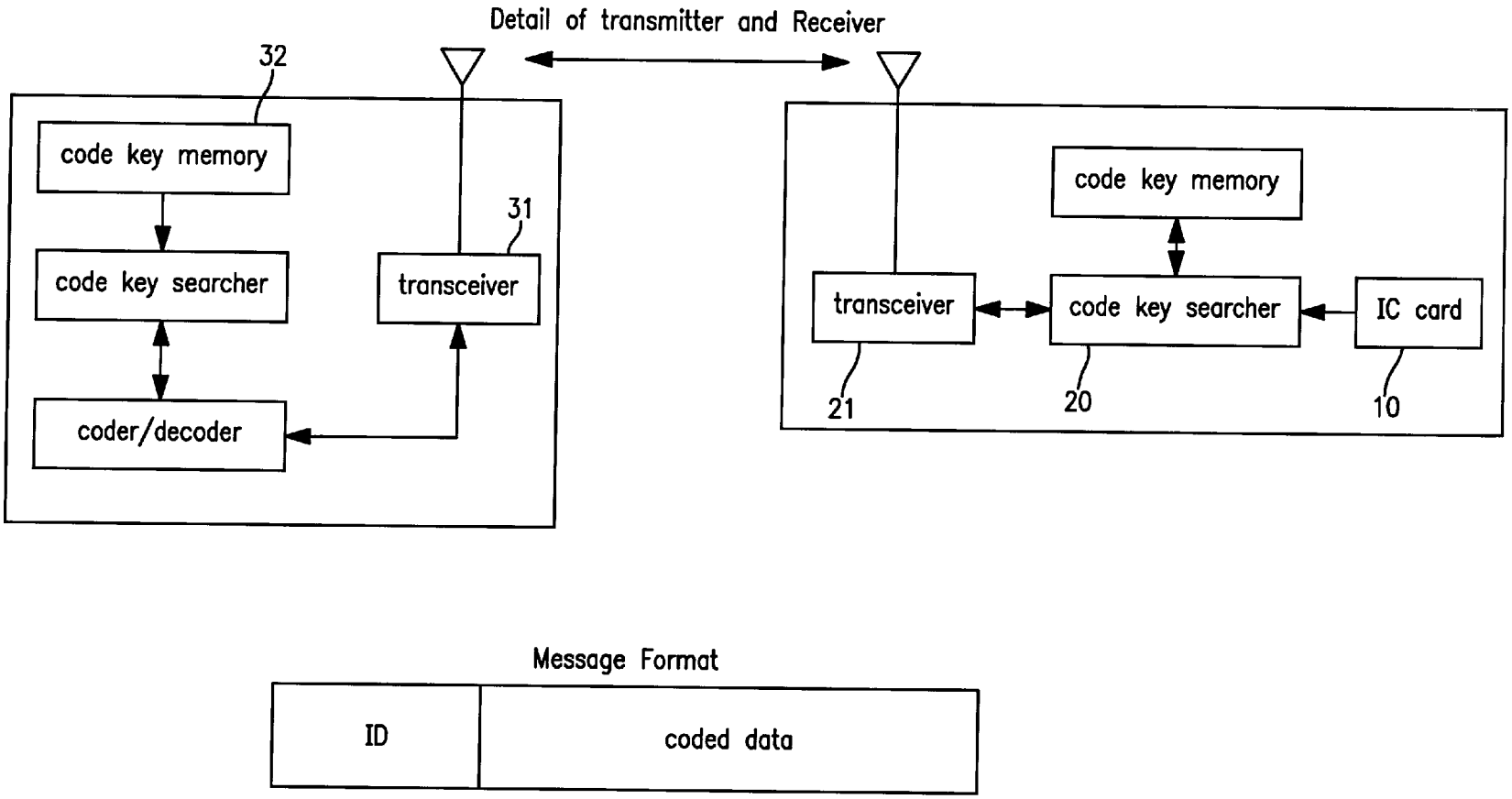
FIG. 3 is a block diagram illustrating communication within the authorization system.

Communication between transceiver 31 and transceiver 21 is accomplished, for example, as shown in FIG. 3.

When the code or cipher of the IC card 10 agrees with the code or cipher of the in-vehicle device 20, the agreed code or cipher is transmitted to the on-road apparatus 30. The on-road apparatus 30 checks it whether the code or cipher is the allowed one by the managing agency of the electronic toll collecting system. If the code is the allowed one, the IC card is available for the electronic toll collecting system. If not, the IC card is rejected by the electronic toll collecting system.

If the code or cipher of the IC card 10 or the in-vehicle device 20 is not the allowed one (which is stored in the on-road apparatus 30), a car with the in-vehicle device 20 not having an allowed code is rejected for electronic toll collecting.

Signal transmission between the on-road apparatus 30 and a car mounting the in-vehicle device 20 is performed when the car passes through a tollgate. Therefore, the on-road apparatus 30 recognizes the in-vehicle device 20 with car by car. In this manner, interference between transmissions from different cars is prevented.

First, IC card 10 is inserted into slot 22 of in-vehicle-device 20 on Step 1 (hereinafter Step is referred to as S). IC card 10 in slot 22 and in-vehicle-device 20 try to authorize each other with an agreement of the codes stored in the respective elements on S2. When both the code agree with, the authorization is established, and device 20 authorizes IC card 10 on S3. IC card 10 also authorizes device 20.

When IC card 10 and in-vehicle-device 20 store code A respectively, an authorization is established on S3 because both the codes agree with. Device 20 then analyzes the information recorded in IC card 10 and transmits it to communicating section 31 of on-road apparatus from communicating section 21 on S4. On-road apparatus 30 transmits the received information to operation center 40 on S5. Operation center 40 calculates the toll to be collected based on the received information, and transmits the information about the toll to be collected to on-road apparatus 30 on S6. Apparatus 30 rewrites a settlement of account of IC card 10 based on the toll information on S7, which completes a toll payment.

When the code of apparatus 30 does not agree with the code of IC card 10 on S2, i.e. when IC card 10 storing code B is inserted to in-vehicle-device 20 storing code A, device 20 determines that authorization cannot be established and detects disagreement of the codes.

When detecting the disagreement of the codes, device 20 informs on-road apparatus 30 of the disagreement on S8. Device 20 and apparatus 30 try to authorize each other also on S8. In this case, since apparatus 30 stores codes A, B and C while device 20 stores code A, the two elements authorize each other because of agreement of the codes.

Once the code agreement is confirmed on S9, in-vehicle-device 20 transmits the information of code-disagreement between device 20 and IC card 10 to on-road apparatus 30 on S10 Apparatus 30 receives this information, then transmits another code, e.g. code B, to device 20 on S10. Device 20 then overwrites code A with code B on S12. In other words, code A recorded in device 20 is replaced with code B. Device 20 storing code B determines again whether or not the code agrees with that in IC card 10 with code B on S13. When the codes agree with, the operation proceeds to S3, and the authorization between IC card 10 and in-vehicle-device 20 is established.

If the codes still do not agree with on S13, the authorization is not established yet, but the steps S8 through S13 should be repeated thereby establishing the authorization without fail.

In the demonstration discussed above, the information determined by device 20 of the code disagreement between in-vehicle-device 20 and IC card 10 is transmitted from device 20 to on-road apparatus 30 on S10. However, the information about which codes are stored in IC card 10 can be transmitted instead of the determined information of the code disagreement. In this case, after confirming the code agreement between in-vehicle-device 20 and on-road apparatus 30 on S9, device 20 transmits the information about the codes stored in IC card 10 to apparatus 30 on S14. On-road apparatus 30 receives the information and transmits the code information recorded in IC card 10 to in-vehicle-device 20 on S15, then the operation proceeds to S12 and S13 which have been already detailed. This case results in a code agreement without fail on S13. Therefore, repetition of steps of S8 through S13—required when an authorization cannot be established—is not needed, and the authorization between device 20 and IC card 10 can be immediately established.

The access of an IC card to an in-vehicle-device can be thus authorized.

In the two-step authorization system, i.e. an on-road apparatus authorizes an in-vehicle-device, and the in-vehicle-device authorizes an IC card, the present invention thus allows the system to operate smoothly even if another IC card—having a code different from the code proper to the in-vehicle-device—is inserted into the in-vehicle-device. Because this another card can be identified through data communication between the in-vehicle-device and the on-road apparatus as the IC card having been authorized by the in-vehicle-device. As a result, the system collects tolls smoothly regardless of what kind of codes an IC card stores.

Figure 4:
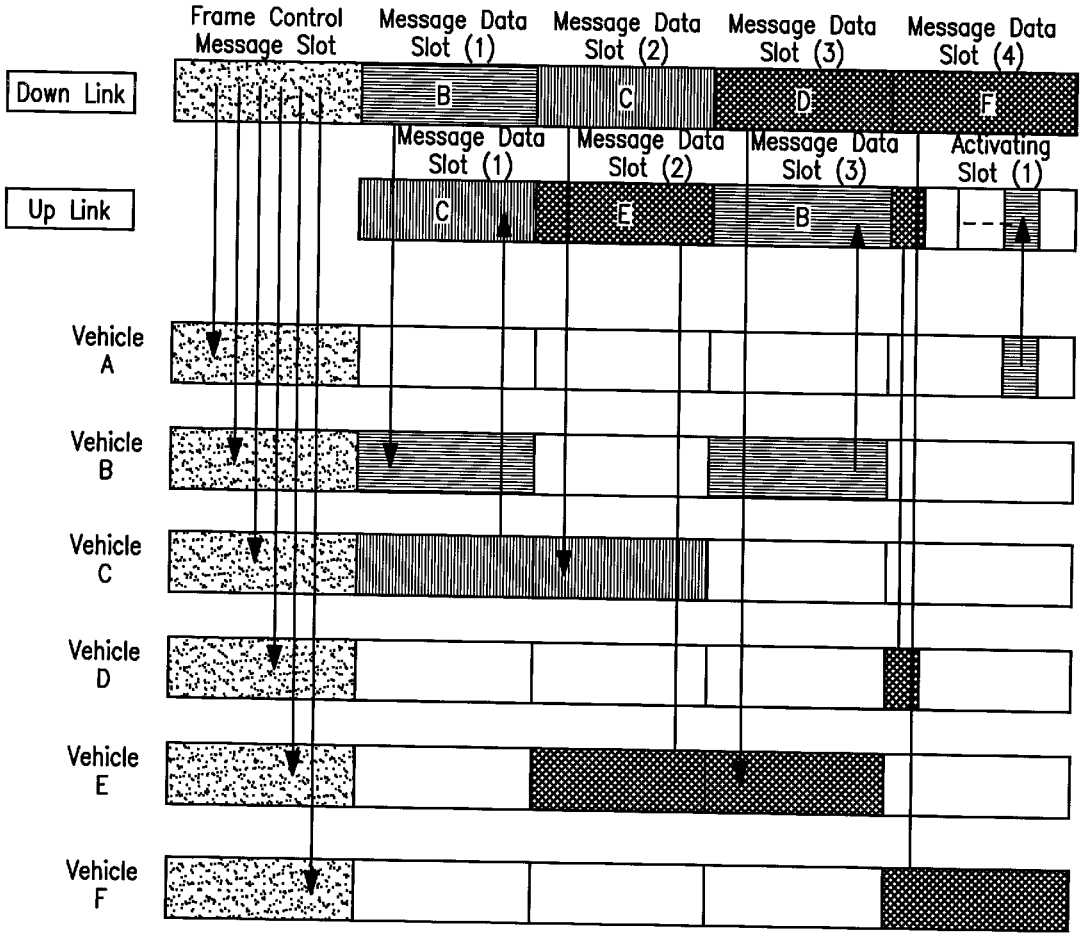
FIG. 4 is a timing diagram illustrating communication when several vehicles are present.

Communication between several vehicles may be accomplished as shown in FIG. 4. In the example, the number $MDS_D$ slots is four, the number of $MDS_U$ slots is three, the number of ACTS slots is one.

FCMS sends the data to all of the vehicles.

Vehicle A through vehicle D are sent "Registration ID" to ACTS.

Vehicle B sends data by $MDS_U(3)$, and receives data by $MDS_D$ to (1).

Vehicle C sends data by $MDS_U(1)$, and receives data by $MDS_D(2)$.

Vehicle E sends data by $MDS_U(2)$,and receives data by $MDS_D(3)$.

Vehicle F receives the data of $MDS_D(4)$.

Figure 5:
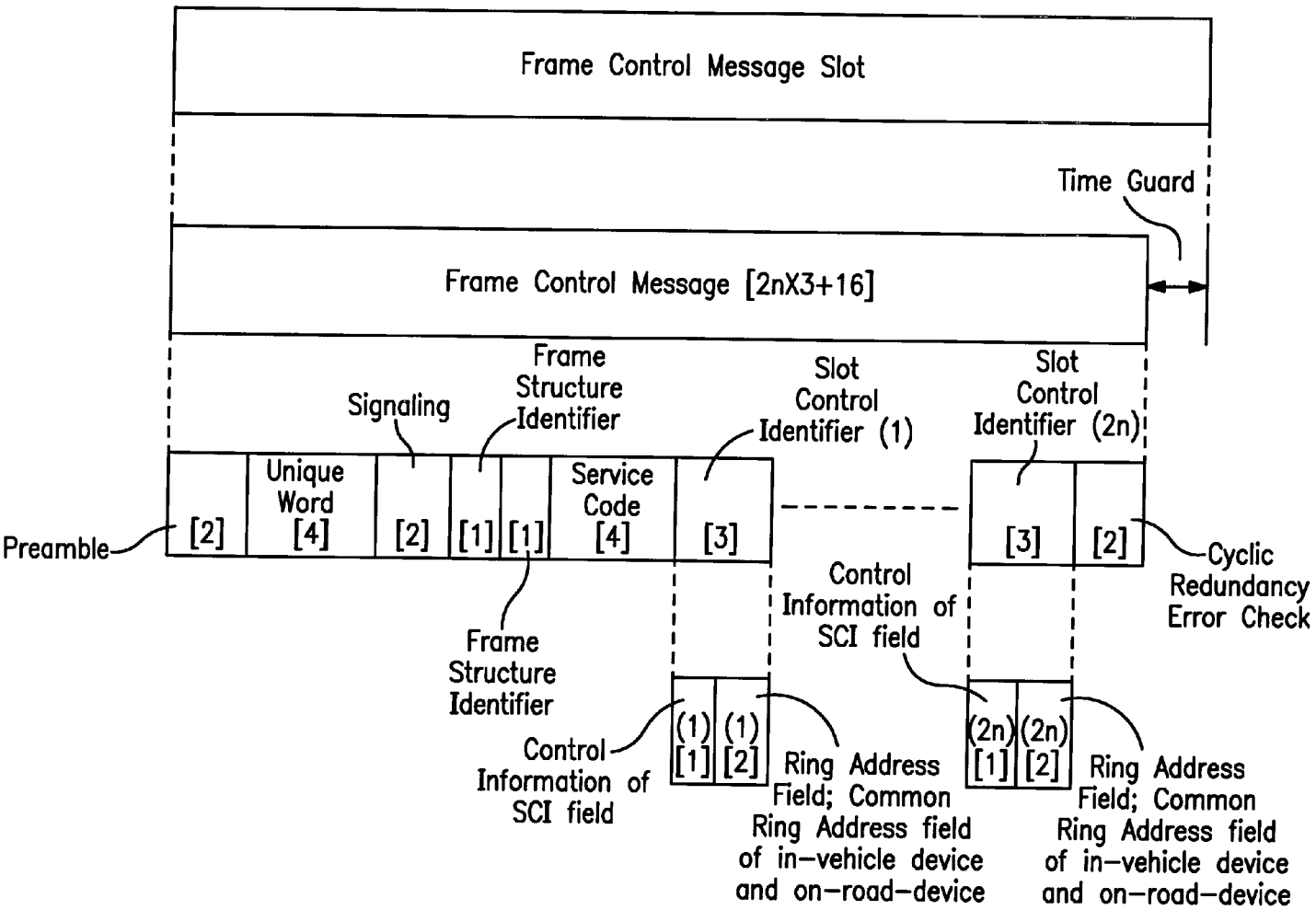
FIG. 5 is a diagram illustrating a portion of message formatting.

The format for the Frame Control Message slot is shown in FIG. 5.

What is claimed is:

1. An authorization system comprising:

an on-road apparatus;

an in-vehicle device; and an IC card, wherein said on-road apparatus authorizes said in-vehicle device, and said in-vehicle device authorizes said IC card, and wherein when another IC card having a code different from a code stored in said in-vehicle device is inserted into said in-vehicle device, said in-vehicle device identifies through data communication between said in-vehicle device and said on-road apparatus that the another IC card has been authorized by said in-vehicle device.

2. An authorization system comprising:

an on-road apparatus;

an in-vehicle device; and an IC card, wherein said on-road apparatus authorizes said in-vehicle device, and said in-vehicle device authorizes said IC card, wherein when another IC card having a code different from a code stored in said in-vehicle device is inserted into said in-vehicle device, said in-vehicle device transmits information of code disagreement to said on-road apparatus, wherein when receiving the information of code disagreement, said on-road apparatus transmits a code different from a present code to said in-vehicle device, wherein when receiving the different code, said in-vehicle device overwrites a now-used code with the different code, and wherein said in-vehicle device and the another IC card authorize each other with the different code.

3. The authorization method as defined in claim 2, wherein when said system fails in the authorization between said in-vehicle device and the another IC card with the different code, said in-vehicle device transmits the information of code disagreement again to said on-road apparatus, wherein when receiving the information, said on-road apparatus transmits another code different from the different code, and repeat this operation until an authorization between said in-vehicle device and the another IC card is established.

4. An authorization system comprising:

an on-road apparatus;

an in-vehicle device; and an IC card, wherein said on-road apparatus authorizes said in-vehicle device, and said in-vehicle device authorizes said IC card, wherein when another IC card having a code different from a code stored in said in-vehicle device is inserted into said in-vehicle device, said in-vehicle device transmits a code of the another IC card to said on-road apparatus via data communication, wherein said on-road apparatus transmits such a code stored in memory 32 as corresponding to the code of the another IC card to said in-vehicle device via data communication, wherein said in-vehicle device identifies the another IC card, through said transmitted code from said on-road apparatus to said in-vehicle device, as a card having been authorized one, wherein an authorization between said in-vehicle device and the another IC card is established.

5. A method for authorization comprising:

authorizing an in-vehicle device by an on-road apparatus; and authorizing an IC card by the in-vehicle device, wherein when another IC card having a code different from a code stored in the in-vehicle device is inserted into the in-vehicle device, the in-vehicle device identifies the another IC card, through data communication between the on-road apparatus and the in-vehicle device, as a card having been authorized by the in-vehicle device.

6. A method for authorization comprising:

authorizing an in-vehicle device by an on-road apparatus; and authorizing an IC card by the in-vehicle device, wherein when another IC card having a code different from a code stored in the in-vehicle device is inserted into the in-vehicle device, the in-vehicle device transmits information of code disagreement to the on-road apparatus, wherein when receiving the information, the on-road apparatus transmits a code different from a present code to the in-vehicle device, wherein when receiving the different code, the in-vehicle device overwrites the present code with the different code, wherein the another IC card and the in-vehicle device authorize each other with the different code.

7. The method of authorization as defined in claim 6, wherein when the authorization between the in-vehicle device and the another IC card fails, the in-vehicle device transmits the information of code disagreement to the on-road apparatus, wherein when receiving the information, the on-road apparatus transmits a different code from the present code to the in-vehicle device, and this operation is repeated until an authorization between the in-vehicle device and the another IC card is established.

8. A method of authorization comprising:

authorizing an in-vehicle device by an on-road apparatus; and authorizing an IC card by the in-vehicle device, wherein when another IC card having a code different from a code stored in the in-vehicle device is inserted into the in-vehicle device, the in-vehicle device transmits a code of the another IC card to the on-road apparatus via data communication, wherein the in-vehicle device identifies the another IC card, through data transmitted from the on-road apparatus to the in-vehicle device, as a card having been authorized by the in-vehicle device, wherein an authorization between the in-vehicle device and the another IC card is established.

9. A method of authorizing an IC card storing a first code, said method comprising:

inserting the IC card into an in-vehicle device storing a second code;

transmitting data from the in-vehicle device to an on-road apparatus storing a plurality of codes;

transmitting data of the codes between the in-vehicle device and the on-road apparatus when the in-vehicle device travels near the on-road apparatus.

10. A method of collecting a toll using a system comprising:

an IC card storing a code for authorization, a vehicle class, a travelling route, and toll information;

an in-vehicle device storing a code for authorization and being able to receive said IC card, an on-road apparatus storing a plurality of codes and being communicable to said in-vehicle device; and an operation center being communicable to said on-road apparatus, said method comprising:

establishing authorizations between said on-road apparatus and said in-vehicle device, and between said in-vehicle device and said IC card through data communication between said on-road apparatus and said in-vehicle device when said in-vehicle device travels near said on-road apparatus, calculating a toll by said operation center after the authorizations are established, and collecting the toll from said IC card by said operation center.

11. An authorization system comprising:

an on-road apparatus;

an in-vehicle device; and an IC card, wherein said on-road apparatus authorizes said in-vehicle device, and said in-vehicle device authorizes said IC card, wherein said system rewrites a code stored in said in-vehicle device to another code for agreeing with a code stored in said IC card.

12. The authorization system as defined in claim 11 wherein the code stored in said in-vehicle device is rewritten when said in-vehicle device being mounted with said IC card travels near said on-road apparatus.

* * * * *

UNITED STATES PATENT AND TRADEMARK OFFICE

CERTIFICATE OF CORRECTION

PATENT NO. : 6,304,192 B1
DATED : October 16, 2001
INVENTOR(S) : Kawasaki

It is certified that error appears in the above-identified patent and that said Letters Patent is hereby corrected as shown below:

Title page,
Item [57], ABSTRACT,
Line 4, before "inserted" insert -- is --.

Signed and Sealed this

Fourth Day of June, 2002

*Attest:*

*Attesting Officer*

JAMES E. ROGAN
*Director of the United States Patent and Trademark Office*